US008677951B2

(12) United States Patent
Laimboeck

(10) Patent No.: US 8,677,951 B2
(45) Date of Patent: Mar. 25, 2014

(54) OPPOSED PISTON ENGINE

(71) Applicant: Mahle Koenig Kommanditgesellschaft GmbH & Co. KG, Rankweil (AT)

(72) Inventor: Franz Laimboeck, Goleta, CA (US)

(73) Assignee: Mahle Koenig Kommanditgesellschaft GmbH & Co. KG, Rankweil (AT)

( * ) Notice: Subject to any disclaimer, the term of this patent is extended or adjusted under 35 U.S.C. 154(b) by 0 days.

(21) Appl. No.: 13/647,795

(22) Filed: Oct. 9, 2012

(65) Prior Publication Data

US 2013/0087115 A1 Apr. 11, 2013

Related U.S. Application Data

(60) Provisional application No. 61/544,368, filed on Oct. 7, 2011.

(51) Int. Cl.
*F02B 75/28* (2006.01)

(52) U.S. Cl.
USPC ..... 123/51 R; 123/192.1; 123/197.3

(58) Field of Classification Search
CPC ..... F02B 75/28; F02B 25/08; F02B 75/06
USPC ..... 123/192.1, 197.3, 51 R
See application file for complete search history.

(56) References Cited

U.S. PATENT DOCUMENTS

| | | | | |
|---|---|---|---|---|
| 1,171,854 | A | 2/1916 | Kraemer | |
| 2,526,384 | A * | 10/1950 | Mercier | 123/46 A |
| 4,419,969 | A * | 12/1983 | Bundrick, Jr. | 123/48 R |
| 6,487,858 | B2 * | 12/2002 | Cammack | 60/517 |
| 2002/0035834 | A1 * | 3/2002 | Cammack | 60/597 |
| 2007/0283909 | A1 * | 12/2007 | Hofbauer | 123/55.3 |
| 2009/0139476 | A1 * | 6/2009 | Hofbauer et al. | 123/55.2 |
| 2010/0224162 | A1 * | 9/2010 | Hofbauer | 123/196 R |

FOREIGN PATENT DOCUMENTS

| | | |
|---|---|---|
| DE | 2 148 138 A1 | 5/1972 |
| GB | 1 365 679 | 9/1974 |

* cited by examiner

*Primary Examiner* — Noah Kamen
*Assistant Examiner* — Long T Tran
(74) *Attorney, Agent, or Firm* — Laurence A. Greenberg; Werner H. Stemer; Ralph E. Locher

(57) ABSTRACT

An opposed piston engine has an outer piston and an inner piston, which are disposed in a cylinder and are driven in opposite directions and delimit a common combustion chamber. The inner piston drives a crankshaft via a connecting rod and the outer piston drives the crankshaft via a pair of traction connecting rods. The outer piston is supported by a connecting rod that is guided linearly in a guide block, and the connecting rod protrudes from a bridge that is connected at both end portions to a traction connecting rod. Accordingly, it is provided that each traction connecting rod contains a U-shaped curved piece of tube, preferably with parallel legs, which with its U-shaped curved portion encloses a part of the circumference of the pivot bearing supported by the bridge and is fixed, especially bolted, with its leg ends onto a traction connecting rod bearing mounted on the crankshaft.

15 Claims, 3 Drawing Sheets

OPPOSED PISTON ENGINE

CROSS-REFERENCE TO RELATED APPLICATION

This application claims the benefit, under 35 U.S.C. §119(e), of provisional application No. U.S. 61/544,368 filed Oct. 7, 2011; the prior application is herewith incorporated by reference in its entirety.

BACKGROUND OF THE INVENTION

Field of the Invention

The invention relates to an opposed piston engine according to the preamble of the claims. Opposed piston engines of this type are, for example, known from German patent DE 21 48 138 or U.S. Pat. No. 1,171,854, but are of complex design; the frictional losses are considerable and the efficiency of these engines and their durability are low.

SUMMARY OF THE INVENTION

According to the invention, an opposed piston engine of the above-mentioned type is characterized by the features mentioned in the characterizing clause of the claims. Accordingly, it is provided that each traction connecting rod contains a U-shaped curved piece of tube, preferably with parallel extending legs, which with its U-shaped curved portion encloses a portion of the circumference of a pivot bearing and which with its leg ends is fixed onto a traction connecting rod bearing that is mounted on, in particular bolted onto, the crankshaft.

The configuration of the opposed piston engine according to the invention allows a linear piston movement with optimized force application to the crankshaft via low-friction bearing components. Because vibration and wobbling motions are substantially prevented, the service lives are increased. Furthermore, it is a tension-resistant and yet simple and light construction traction connecting rod.

The configuration of an opposed piston engine is simple or the strength characteristics are increased, if the connecting rod has a fixed connection to the bridge or if the bridge and the connecting rod are constructed in the form of a one-piece component and/or if the inner piston is fixed to a connecting rod or the inner piston and the connecting rod are constructed as a one-piece component. The connecting rod is linearly movably mounted in a guide and is connected at its end remote from the piston to a bearing loop, which is mounted on the crankshaft.

An optimal force transfer from the outer piston to the crankshaft, wherein wobbling movements are prevented, occurs if the two end portions of the bridge are constructed as bearing arms. Each of the bearing arms carries a pivot bearing, preferably a pivot pin bearing, whose outer ring, preferably having a spherically curved inner surface, is supported by the end of the respective traction connecting rod remote from the crankshaft and/or if the bridge contains two plane parallel outer surfaces, which lie parallel to the plane formed by the cylinder axis and the axis of the crankshaft, and if the bridge is guided with these outer surfaces in a groove or recess of the guide block with guide surfaces and possibly with rollers.

Vibrations are substantially prevented or the strength is increased, if the opposing legs of each traction connecting rod are connected to a vibration damping component, which is fixed to the legs eccentrically relative to the length of the axis of the traction connecting rod bearing and the axis of the pivot bearing of a traction connecting rod.

Friction losses between the moving components are prevented, if an oil conduit is led from the connecting rod of the outer piston into the base of the outer piston and from there back to the connecting rod and from this to the gap between the outer surfaces of the bridge and the guide surfaces of the guide block and/or to the pivot bearings.

Linear guidance of the pistons or the connecting rod and the connecting rod and the bridge is achieved if the guide block and the main bearing of the crankshaft and the guide are disposed in a positionally invariant relationship relative to each other or are disposed in an engine block so as to be positionally fixed relative to each other.

A simple structure of the end of the cylinder in the case of simultaneous guidance of the pistons occurs if the guide block of the outer end of the cylinder is formed on the side of the outer piston facing away from the combustion chamber and/or if the guide of the outer end of the cylinder is formed on the side of the inner piston facing towards the crankshaft.

In the case of the opposed piston engine according to the invention, which is driving only one crankshaft, the outer piston is connected to the crankshaft via the traction connecting rods disposed on both sides of the cylinder. The traction connecting rod or the tubes forming the traction connecting rod have the necessary tensile strength and can be configured simply and easily using existing materials. The wobbling motion of the bearing carried on the crankshaft that is caused by the crankshaft is absorbed by the tubes of the traction connecting rod without adversely affecting their strength. In particular, through the mounting of the U-shaped bend of the traction connecting rod on the arms of the bridge with pivot bearings, it is achieved that bending of the legs of the traction connecting rod is inhibited despite the wobbling motion of the traction connecting rod bearing.

The pivot bearings for the traction connecting rod are advantageously formed by pivot pin bearings, wherein the inner surface of the hub or of the outer ring has a spherical cross-section. The pivot bearings can be mounted by a filling slot and can be rotated through 90° during fitting.

The bridge has two plane parallel outer surfaces, which guide the bridge in the guide block and are used to absorb the lateral forces that are caused by the traction connecting rod swivel movements; furthermore, wobbling of the bridge about the cylinder axis, caused by traction connecting rod flexural vibrations and crankshaft torsion, is prevented.

The guide bearings for the bridge can be implemented as grooves in the crankcase and simultaneously also form the lower cylinder end. The guide bearings can be in the form of large area plain bearings and can be provided with lubrication grooves, into which the oil conduit opens, which can also be led over the outer piston. Alternatively or additionally, rollers are provided for supporting the bridge, preferably needle bearing rollers, which are disposed as far as possible from the cylinder axis laterally towards the outside in the direction of the arms of the bridge, in order to be able to better absorb the wobbling motions of the bridge.

Other features which are considered as characteristic for the invention are set forth in the appended claims.

Although the invention is illustrated and described herein as embodied in a tension conrods with a bridge and a piston, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 2:
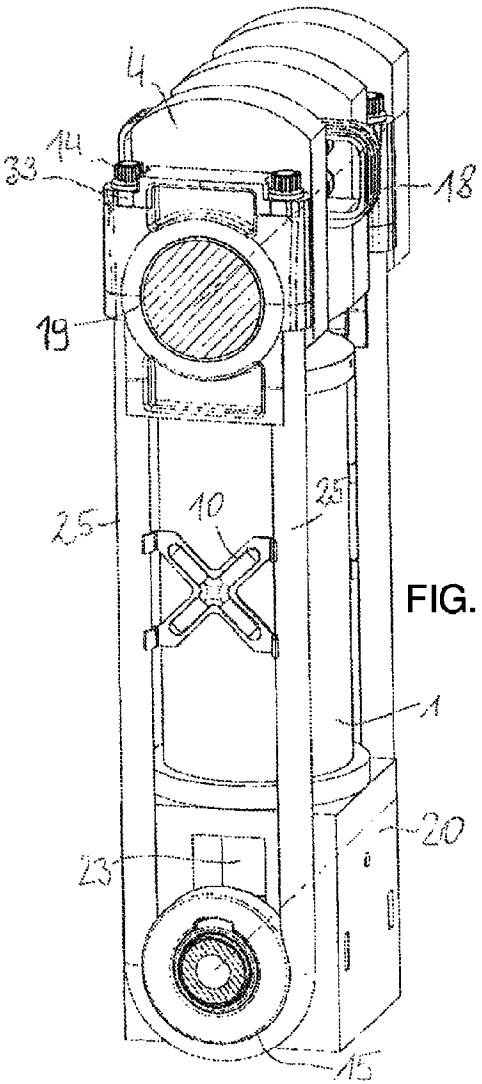
FIG. 2 is a perspective view of the opposed piston engine.
Figure 1:
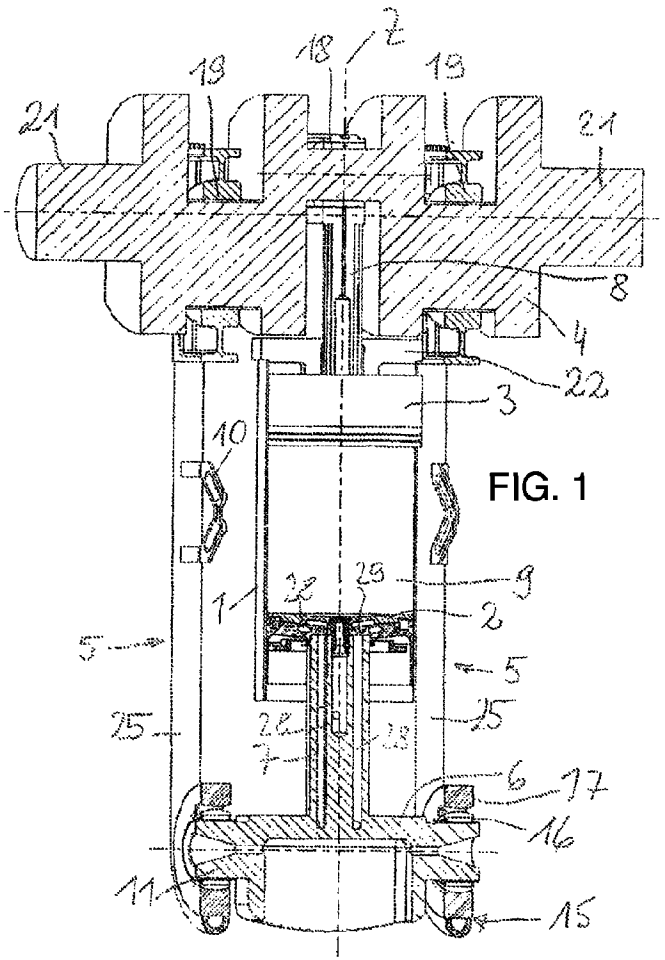
FIG. 1 is a diagrammatic sectional view through an opposed piston engine according to the invention.

Referring now to the figures of the drawing in detail thereof, there is shown in FIG. 1 an opposed piston engine according to the invention, in a partial sectional view. The opposed piston engine contains an outer piston 2 and an inner piston 3, which are disposed in a cylinder 1 and delimit a combustion chamber 9. Upon the ignition of a fuel-air mixture in the combustion chamber 9, an opposite movement of the inner piston 3 relative to the outer piston 2 takes place. The inner piston 3 has a fixed connection to a connecting rod 8, which is connected to a crankshaft 4. The outer piston 2 has a fixed connection to a connecting rod 7, which is connected to a bridge 6. The connecting rod 8 is guided linearly in a guide 22 or a guide bearing 22 and carries a bearing loop 18 on its end that is further from the piston, in which bearing loop a throw of the crankshaft 4 is guided. The crankshaft 4 throw can move reciprocally in the bearing loop 18, while the bearing loop 18 carries out a linear movement corresponding to the movement of the connecting rod 8 in the direction of an axis Z of the cylinder 1.

Figure 4:
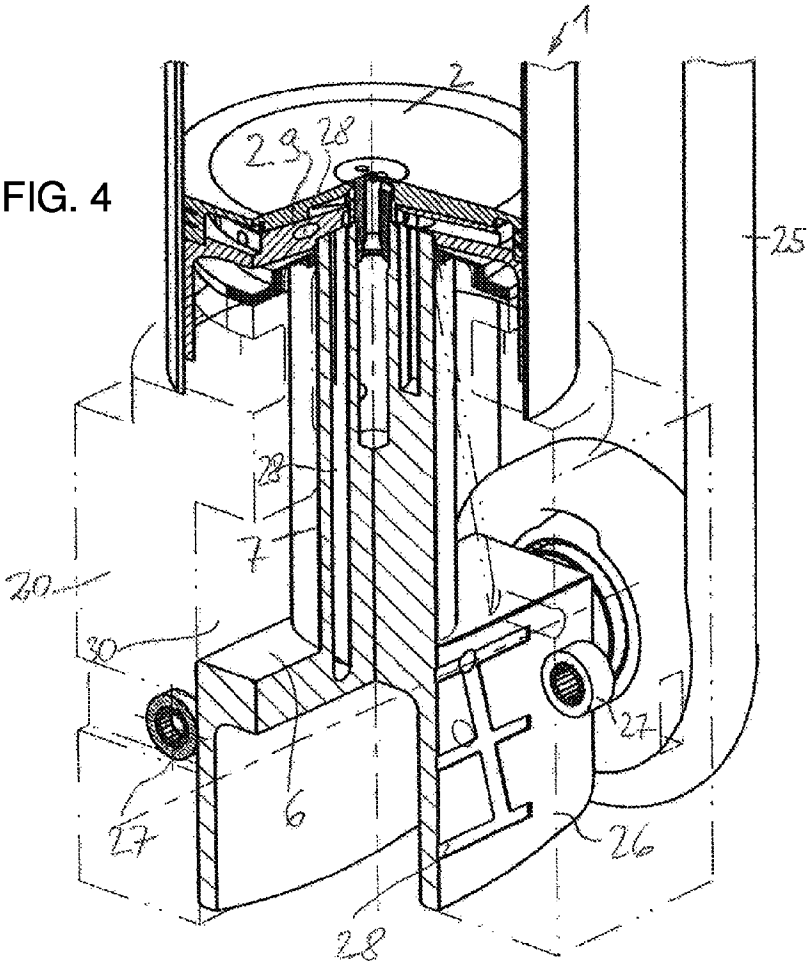
FIGS. 3 and 4 are diagrammatic, detailed sectional view of parts of the opposed piston engine.

The outer piston 2 has a fixed or rigid connection to the connecting rod 7, if necessary by a screw connection. The connecting rod 7 carries out a linear movement along the axis Z of the cylinder 1 in a guide block 20, as can be seen in schematic form in FIGS. 2, 4, 5 and 6. The connecting rod 7 carries out its linear movement also along the axis Z of the cylinder 1 and moves a bridge 6, which is mounted so as to be reciprocally movable in the guide block 20. In the guide block 20, as illustrated in FIG. 4, there is a recess 23 formed with guide surfaces 30, in which the bridge 6 is mounted, if necessary with the aid of guide rollers 27. The crankshaft 4 is mounted with crankshaft journals 21 in crankshaft bearings that are not illustrated. The crankshaft bearings and guide bearing 22 and also the guide block 20 are disposed in invariant positions relative to each other, so that the geometry of the movement of the outer piston 2 and of the inner piston 3 is predetermined. The bridge 6, the connecting rod 7 as well as the outer piston 2 and the inner piston 3 as well as the connecting rod 8 and the bearing loop 18 carry out mutually parallel, linear movements in relation to the axis Z.

Figure 3:
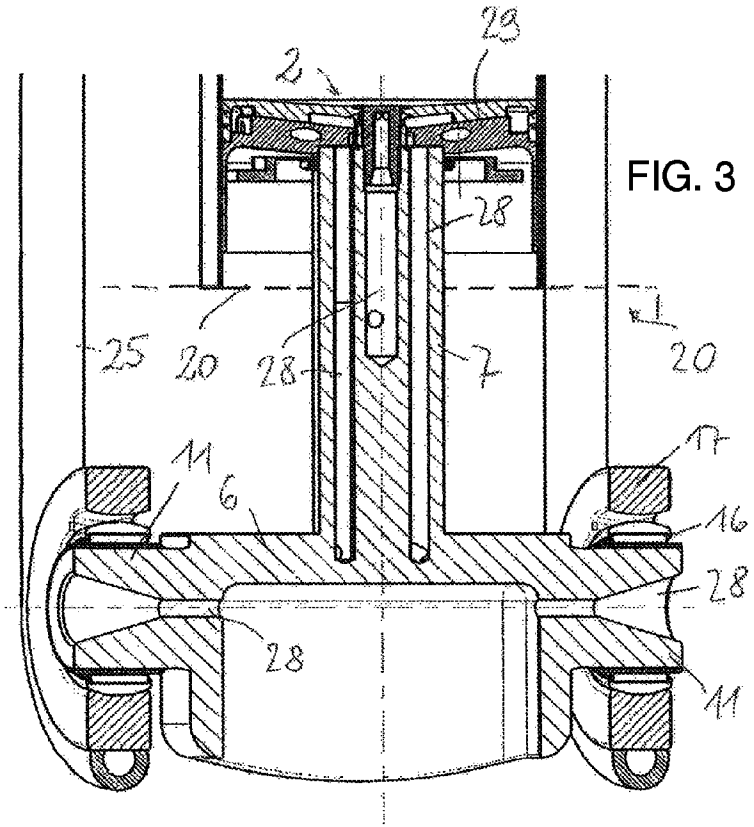
Figure 6:
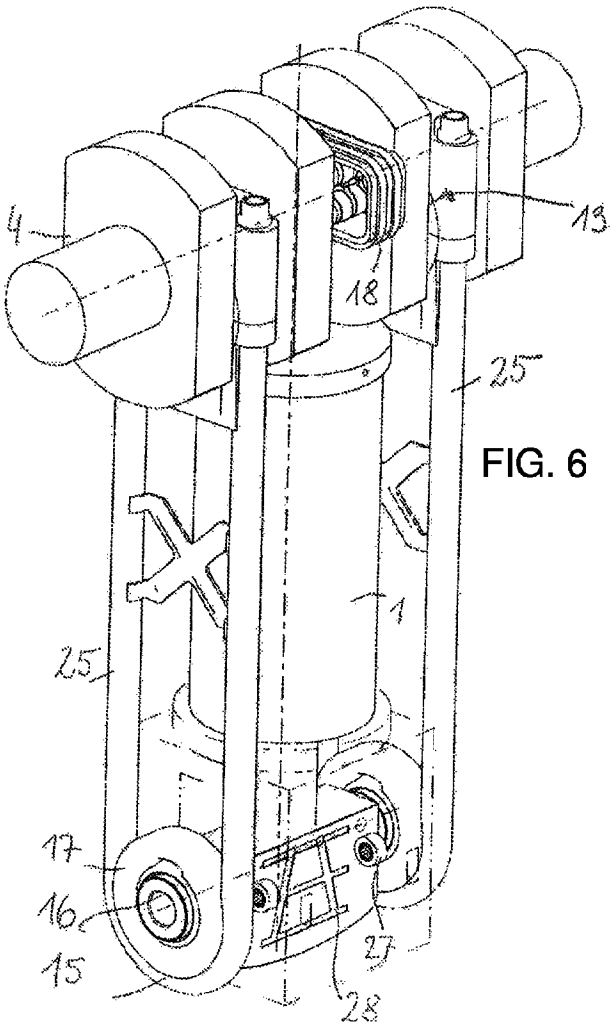
FIG. 6 is a diagrammatic, perspective view of the opposed piston engine.
Figure 5:
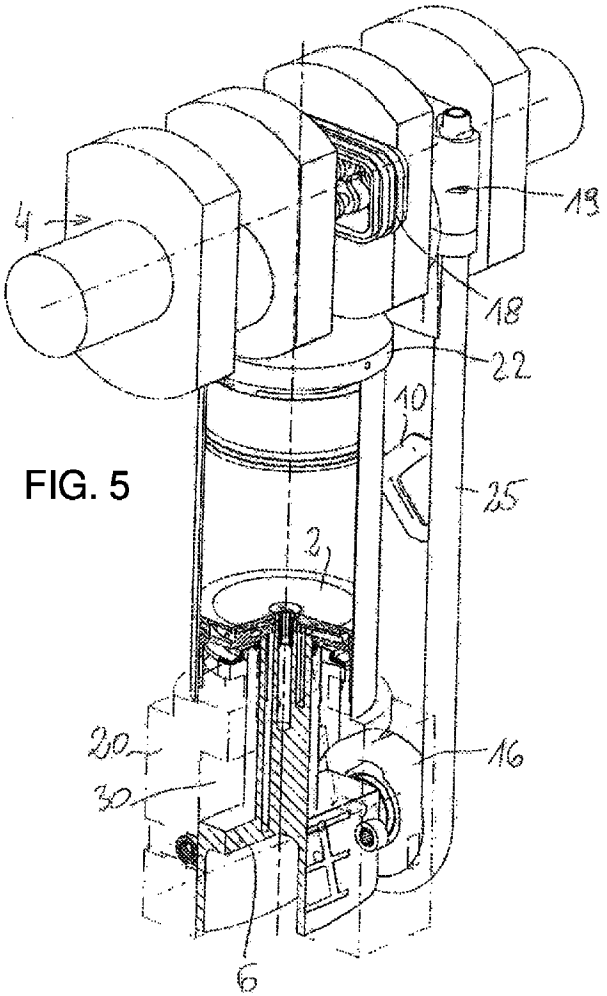
FIG. 5 is a diagrammatic, perspective and partially sectional view of the opposed piston engine.

The bridge 6 contains bearing arms 11 on both sides in accordance with FIGS. 1 and 3, each of which carries a pivot bearing 16. The pivot bearing 16 is enclosed by a bearing ring or a hub 17, which is connected to a traction connecting rod 5. The traction connecting rod 5 contains a tubular part, which is bent into a U-shape and contains two legs 25, which are bent about the hub in a bend 15 along a circumferential portion of the hub 17. Free ends 33 of the legs 25 are advantageously fixed by bolts 14 in a traction connecting rod bearing 19, which is seated on the crankshaft 4.

The legs 25 of the traction connecting rod 5 advantageously run parallel to each other. The bearing ring 17 can be connected to the inner side of the bend 15 of the traction connecting rod 5 by welding. The two legs 25 of the traction connecting rod 5 can be connected eccentrically to a component 10, which acts as a vibration damper and simultaneously as a stiffening component.

The bridge 6 contains two plane-parallel surfaces 26, which are disposed opposite to the wall surfaces 30 of the groove 23 formed in the guide block 20. An oil film is maintained between these surfaces. The oil film, as with the lubrication of the other components that move relative to each other, can be produced in such a way that a forced oil supply is produced with an oil conduit 28, with which oil introduced into the connecting rod 7 is supplied via the connecting rod to the outer piston 2 and is distributed in a piston base 29. Oil distributed in the piston base 29 for cooling purposes is fed back through the connecting rod 7 and is delivered into an oil conduit 28 opening into the outer surfaces 26 in the gap between the outer surfaces 26 and the wall surface 30. Oil can simultaneously also be supplied through the oil conduit 28 to the pivot bearings 16, which are supported by the arms 11 of the bridge 6.

A comparable oil supply for lubrication and cooling purposes can also be provided for the inner piston 3, wherein oil is supplied to the inner piston 3 via its connecting rod 8, is distributed in the piston base and supplied to the bearing loop 18. Upon ignition of the fuel-air mixture in the combustion chamber 9, the two pistons 2, 3 are forced apart from each other. The inner piston 3 and the outer piston 2 essentially act simultaneously on the crankshaft 4; the inner piston 3 acts via the connecting rod 8 directly on the crankshaft, whereas the outer piston 3 acts on the crankshaft 4 indirectly via the traction connecting rod 5.

The thickness of the bridge 6 and the diameter of the connecting rod 7 can be of the same dimension.

The installation position of the opposed piston engine can be selected optionally, e.g. vertical, inclined or horizontal.

The invention claimed is:

1. An opposed piston engine, comprising:

a crankshaft;

connecting rods;

a guide block;

a bridge;

a pair of traction connecting rods;

a cylinder;

an outer piston and an inner piston disposed in said cylinder and driven in opposition and delimit a common combustion chamber, said inner piston driving said crankshaft via one of said connecting rods and said outer piston driving said crankshaft via said pair of traction connecting rods, and said outer piston supported by another one of said connecting rods linearly guided in said guide block and protruding from said bridge, said bridge connected at both of bridge end portions to said traction connecting rods;

pivot bearings;

a traction connecting rod bearing mounted on said crankshaft; and each of said traction connecting rods having a U-shaped curved piece of tube, said U-shaped curved piece of tube enclosing a part of a circumference of one of said pivot bearings supported by said bridge, and said U-shaped curved piece of tube having leg ends fixed onto said traction connecting rod bearing mounted on said crankshaft.

2. The opposed piston engine according to claim 1, wherein said one connecting rod has a fixed connection to said bridge.

3. The opposed piston engine according to claim 1, further comprising outer rings; and wherein said bridge has two end portions constructed as bearing arms, each of said bearing arms carrying one of said pivot bearings having one of said outer rings being supported by an end of a respective one of said traction connecting rods being furthest from said crankshaft.

4. The opposed piston engine according to claim 3, wherein:

said pivot bearings are pivot pin bearings; and said outer ring has spherically curved inner surface.

5. The opposed piston engine according to claim 1, further comprising a vibration damping component; and wherein said traction connecting rods each have opposed legs connected to said vibration damping component, said vibration damping component connects said opposed legs of each said traction connecting rod eccentrically relative to an axis of said traction connecting rod bearing and an axis of said pivot bearing.

6. The opposed piston engine according to claim 1, wherein:

said guide block has a recess formed therein defined by guide surfaces; and said bridge has two plane parallel outer surfaces, which are disposed parallel to a plane defined by a cylinder axis and an axis of said crankshaft, and said bridge is guided with said two plane parallel outer surfaces in said recess of said guide block via said guide surfaces.

7. The opposed piston engine according to claim 6, further comprising guide rollers for aiding in a mounting of said bridge 6.

8. The opposed piston engine according to claim 1, further comprising an oil conduit leading from said connecting rod of said outer piston into a piston base of said outer piston and from there back into said connecting rod and/or from there into a gap between outer surfaces of said bridge and guide surfaces of said guide block and/or to said pivot bearings.

9. The opposed piston engine according to claim 1, further comprising a bearing loop mounted on said crankshaft;

further comprising a guide bearing; and wherein said inner piston is fixed to said connecting rod, said connecting rod is mounted so as to be movable linearly in said guide bearing and is connected at an end furthest from said inner piston to said bearing loop.

10. The opposed piston engine according to claim 9, wherein said guide block, a main bearing of said crankshaft, and said guide bearing are disposed so as to be positionally invariant relative to each other.

11. The opposed piston engine according to claim 9, wherein:

said guide block forms an outer end of said cylinder on a side of said outer piston facing away from said combustion chamber; and said guide bearing forms an outer end of said cylinder on a side of said inner piston facing towards said crankshaft.

12. The opposed piston engine according to claim 9, further comprising a bearing loop mounted on said crankshaft; and wherein said inner piston and said connecting rod are constructed as a one-piece component, said connecting rod is mounted so as to be movable linearly in said guide bearing and is connected at an end furthest from said inner piston to said bearing loop.

13. The opposed piston engine according to claim 9, further comprising an engine block; and wherein said guide block, a main bearing of said crankshaft, and said guide bearing are disposed in said engine block so as to be positionally fixed relative to each other.

14. The opposed piston engine according to claim 1, wherein:

said U-shaped curved piece of tube has parallel legs; and said leg ends are bolted onto said traction connecting rod bearing.

15. The opposed piston engine according to claim 1, wherein said bridge and said connecting rod are constructed as a one-piece component.

* * * * *